United States Patent [19]

Baumberger

[11] Patent Number: 4,641,470

[45] Date of Patent: Feb. 10, 1987

[54] CONSTRUCTION ELEMENT

[76] Inventor: Werner Baumberger, 25, chemin du Point-du-Jour 1202 - Geneve, Switzerland

[21] Appl. No.: 761,228

[22] Filed: Jul. 31, 1985

[30] Foreign Application Priority Data

Aug. 15, 1984 [CH] Switzerland ..... 03914/84

[51] Int. Cl.[4] ..... E04B 5/04

[52] U.S. Cl. ..... 52/309.17; 52/605; 52/612

[58] Field of Search ..... 52/309.12, 309.17, 605, 52/612; 106/94

[56] References Cited

U.S. PATENT DOCUMENTS

| | | | |
|---|---|---|---|
| 4,130,973 | 12/1978 | Gustavsson | 52/309.17 |
| 4,263,372 | 4/1981 | Emmons | 52/309.17 |
| 4,309,325 | 1/1982 | Laquerbe | 106/94 |
| 4,372,092 | 2/1983 | Lopez | 52/612 |

FOREIGN PATENT DOCUMENTS

| | | |
|---|---|---|
| 480990 | 3/1948 | Belgium . |
| 2914647 | 10/1980 | Fed. Rep. of Germany . |
| 2189601 | 1/1974 | France . |
| 2237018 | 2/1975 | France . |
| 2442930 | 6/1980 | France . |
| 2446704 | 8/1980 | France . |
| 2456179 | 8/1980 | France . |

OTHER PUBLICATIONS

Van Norstrand's Scientific Encyclopedia, Fifth Edition, 1976, p. 1372.

*Primary Examiner*—Henry E. Raduazo
*Attorney, Agent, or Firm*—Young & Thompson

[57] ABSTRACT

The construction element comprises two different parts. A first bearing part (1) has cavities of cylindrical cross-section with rounded ends and is constituted by light concrete having a resistance to compression comprised between 25 and 175 kg/cm$^2$ and an apparent density comprised between 900 and 1250 kg/m$^3$. The second insulating part (2), of an apparent density of at most 270 kg/m$^3$, is constituted of an hydraulic binder based on cement, a synthetic resin and an expanded mineral filler. The heat transmission coefficient k in the direction perpendicular to said parts of the monolithic element is less than or equal to k=0,40 (W/mK).

9 Claims, 7 Drawing Figures

FIG. 5
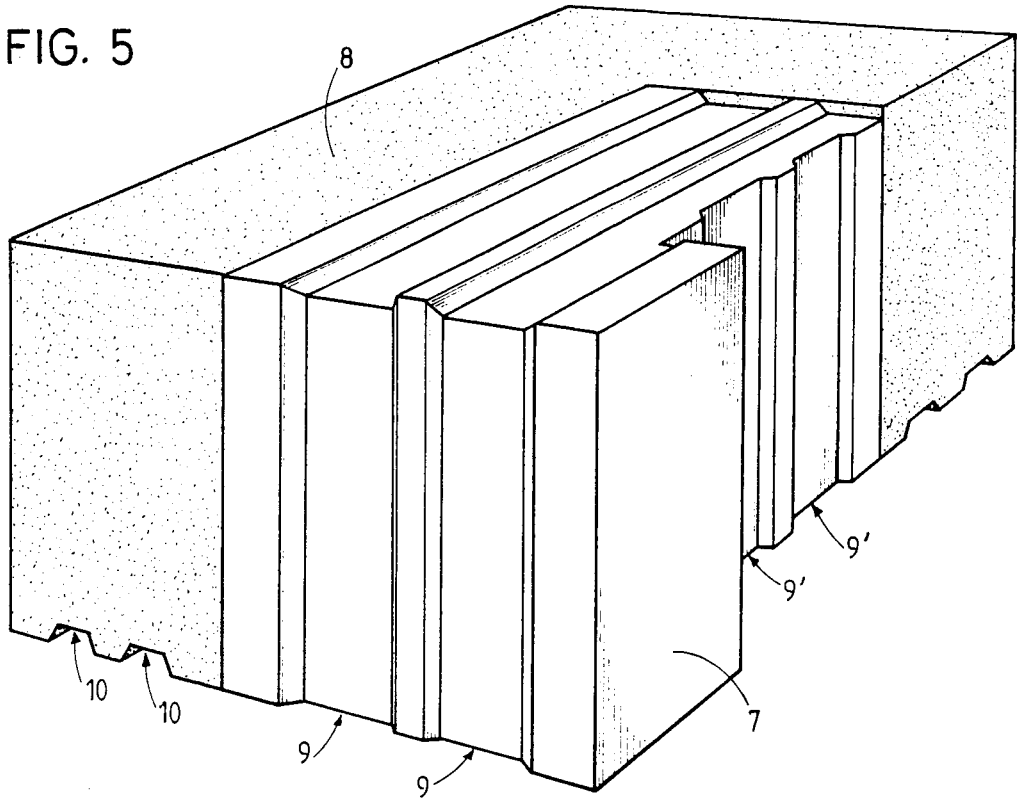
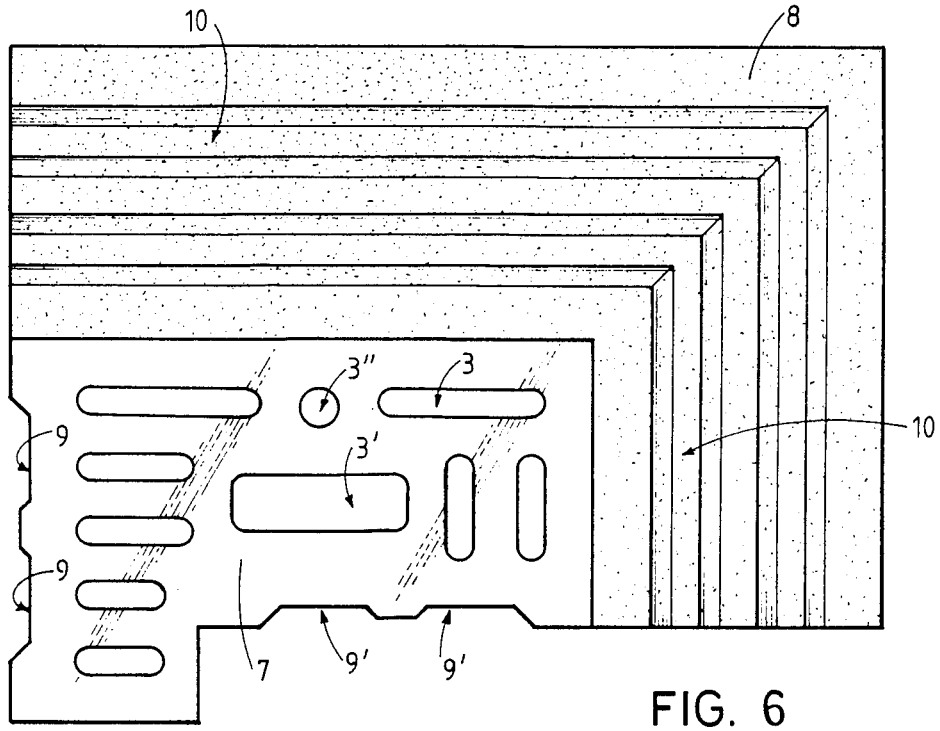
FIG. 6

CONSTRUCTION ELEMENT

The present invention relates to a construction element, and more particularly to a monolithic construction element comprising two distinct parts in its thickness.

Construction elements or bricks are already known, made for example of concrete, which are covered on at least one of their faces with an insulating layer. This insulating layer can be constituted by grains of an insulating material such as cork embeded in a cement mortar, as described in FR Pat. No. 2,237,018, or by multicellular concrete as described in BE patent 480,990. However, it is not possible with such elements to obtain a heat transmission coefficient k which is sufficiently low so as to satisfy the actual requirements for the building's insulation. As a matter of fact, too great an increase of the insulating layer would be prejudicial to the concrete element and would lead to a weakening thereof which could thus no longer be used for the construction of bearing walls.

Therefore the purpose of this invention is to provide a construction element of the precited type which precludes the above mentioned drawback, that is, which can be used as a bearing element and which has a heat transmission coefficient k lower than that of the known elements of the art.

The construction element according to the invention attaining the above mentioned purpose, is characterized in that the first part is a bearing one, said first bearing part having cavities of cylindrical shape having in cross section rounded ends and being made of a light concrete having a resistance to compression comprised between 25 and 175 kg/cm$^2$ and an apparent density comprised between 900 and 1250 kg/m$^3$; the second part is an insulating one, said second insulating part being solid and having an apparent density at the most of 270 kg/m$^3$, and being constituted of an hydraulic binder based on cement, a synthetic resin and an expanded mineral filler, the thickness of the bearing part being greater than that of the insulating part; and the heat transmission coefficient k in a direction perpendicular to said parts of the monolithic element is less than or equal to k=0.40 (W/mK).

Preferably, the first bearing part is light concrete, or if desired a synthetic resin, the concrete being itself formed of a conventional cement binding a light material such as blast-furnace slag, pumice stone, crushed terracotta, expanded clay, ton or slate, pozzolana, etc. The choice of this material depends on the desired characteristics for the construction element; for example, an expanded slag will be preferably used in order to obtain an element having a high resistance to compression (about 165 kg/cm$^2$ for an apparent density of about 1250 kg/m$^3$), whereas pumice stone will be preferably used in order to obtain an element having better insulating characteristics, but a lower compressive strength (of about 40 kg/cm$^2$ for an apparent density of about 1000 kg/m$^3$).

With regard to the second insulating part, it is preferably constituted of a hydraulic binder, for example a cement, and a synthetic resin embedding an expanded mineral filler, for example expanded or cellular glass beads, vermiculite, granulated polyurethane, expanded mica or polystyrene, wood chips, etc.

The accompanying drawings illustrate the invention schematically and by way of example.

FIG. 5 is a plan view from above of a corner element, and FIG. 6 is a plan view from beneath this corner element.

Figure 1:
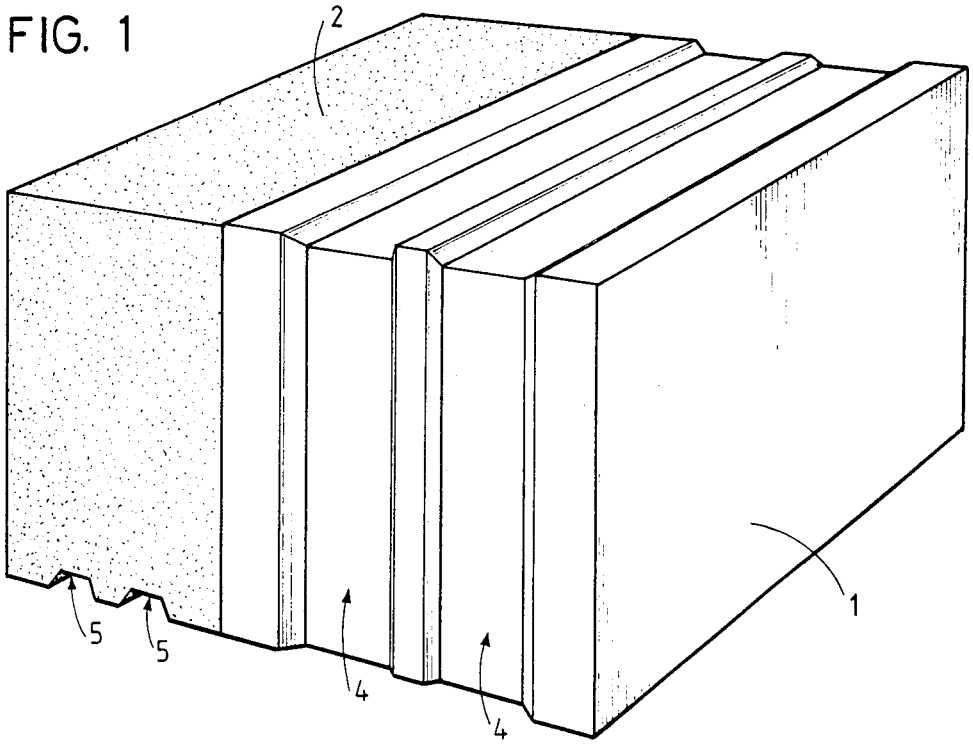
FIG. 1 is a perspective view from above of a construction element according to the invention.
Figure 2:
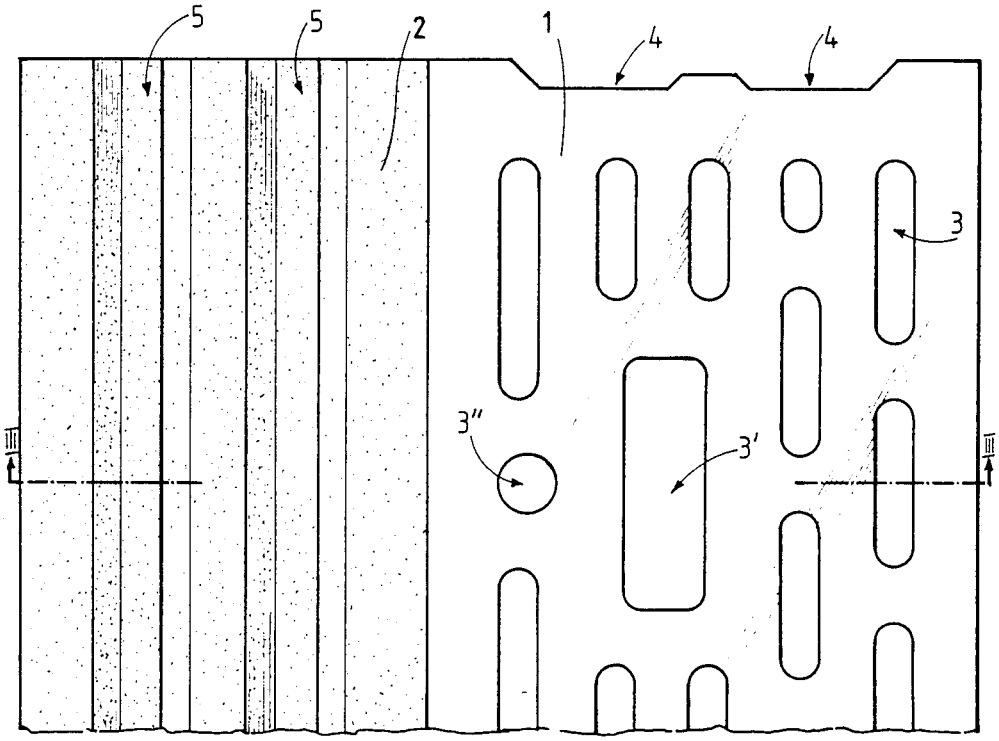
FIG. 2 is a plan view from beneath the element according to FIG. 1.
Figure 3:
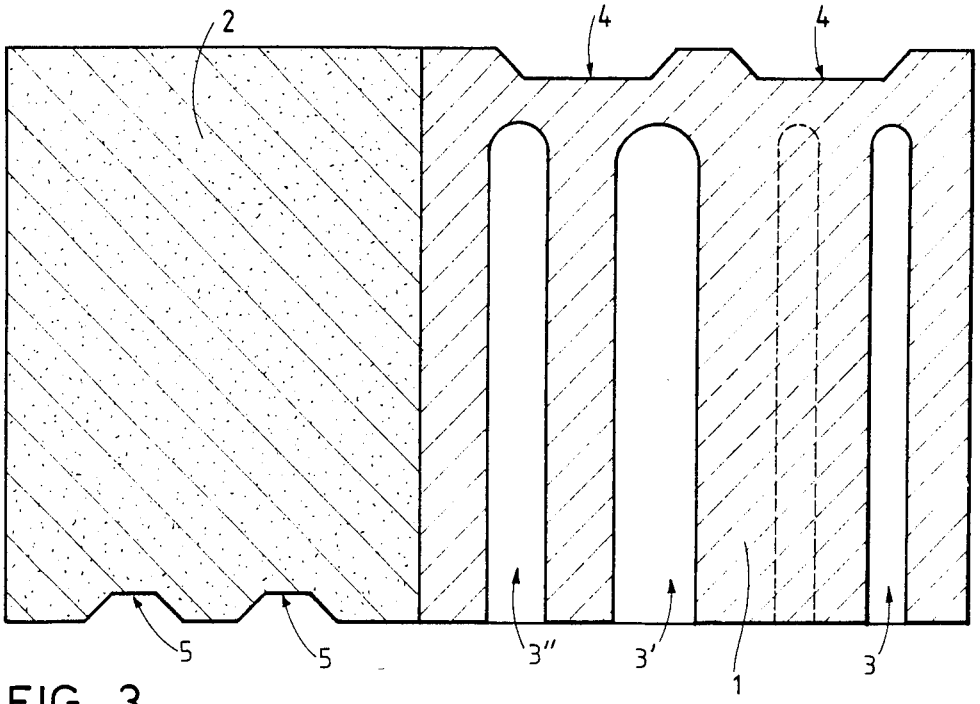
FIG. 3 is a cross-section view along line III—III of FIG. 2.

With reference first to FIGS. 1 to 3, the construction element illustrated is the perpend type and comprises a bearing part 1 made of light concrete as described above and an insulating part 2 also made as previously described. Preferably, the thickness of the insulating part 2 constitutes at least 40% of the total thickness of the element, but is less than that of the bearing part 1.

The bearing part 1 has blind cylindrical cavities for example with sections respectively having the shape of elongated slots with rounded ends 3, of rectangles with rounded angles 3', circles 3'', etc. Preferably, these various cavities are located as shown in FIG. 2, that is in alternate rows across the thickness of the part 1, in such a manner as to provide the best possible resistance to heat transmission. The volume formed by the cavities 3, 3', 3'' is approximately 25% of the total volume of the bearing part 1.

Furthermore, each of the bearing parts 1 and insulating parts 2 has coupling grooves 4,5 which permit secure stacking of the construction elements.

Figure 4:
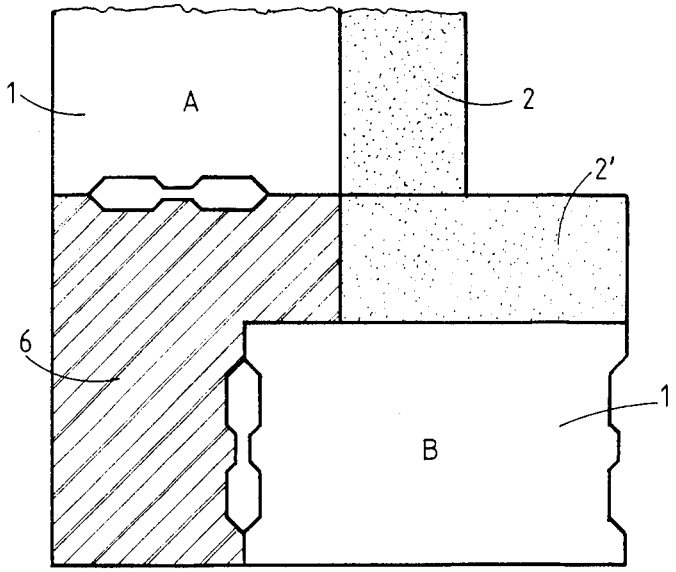
FIG. 4 is a plan view from above of an interiorly projecting corner with two construction elements according to the invention.

An embodiment of an interiorly projecting corner is schematically illustrated in FIG. 4, said corner having two elements A and B each formed of a bearing part 1 and an insulating part 2, 2', the insulating part 2' of the element B not extending up to the end thereof on one side of said element. The corner binding between the two elements A and B is obtained by a corner 6, which has a portion 6' taking the place of the lacking portion of the insulating part 2' of the element B.

Finally, with reference to FIGS. 5 and 6, an exteriorly projecting corner element is shown, which is formed of a bearing part 7 having a generally rectangular shape and an insulating part 8 bordering said bearing part 7 along two of its adjacent sides. As in the case of the simple element, the bearing part 7 has blind cavities 3, 3', 3'' and coupling grooves 9, 9' whereas the insulating part 8 also has coupling grooves 10.

The construction elements according to the invention, as described above by way of example, have a heat transmission coefficient k lower than about 0.35 W/mK (1 W/mK=0,860 kcal/mh°C.); for example, with a bearing part basically made of an expanded slag (density=about 1250 kg/m$^3$), a coefficient k of about 0.3 is obtained, whereas with a bearing part basically made of pumice stone, the coefficient k of the obtained element is about 0.25. Such values are quite appropriate to allow the construction of a wall, by using the elements according to the invention, the heat transmission coefficient k of which being less than or equal to 0.4 (including the external and internal rough casts, as well as the jointings).

By way of example, there will now be presented the heat transmission characteristics of one m$^2$ of wall with a total thickness of 38.5 cm, realized with elements according to the invention having a thickness of 35 cm, and comprising the following components from outside toward inside, as well as 5 horizontal jointings:

external rough-cast: 2 cm ($\lambda$=0.87 W/mK)
element according to the invention:
insulating part comprising cellular glass beads; 15 cm ($\lambda$=0,078 W/mK) see following weight analysis.
The material "SILIPERL" having a lambda of 0.075 W/mK does not resist alkali, which is why we have taken account in the weight analysis only of the material "DENNERT" resistant to alkali according to EMPA test No 48 374/1 and have a lambda of 0.078 W/mK.
bearing part based on expanded slag balls: 20 cm ($\lambda$=0.30 W/mK)
internal rough-cast: 1.5 cm ($\lambda$=0.70 W/mK).

In the above example, the element itself has a heat transmission coefficient k=0.386.

The composition of the various portions of the wall is the following:

(a) Element according to the invention
bearing part (20 cm thickness) expanded blast furnace slag balls

| | |
|---|---|
| ("GALEX" type) | |
| 0–3 mm | 5.168 kg |
| 4–10 mm | 11.320 kg |
| Ordinary Portland cement | 4.200 kg |
| *Synthetic resins | 0.378 kg |
| $\frac{E}{C}$ tot. 0.30 | 1.260 kg |
| Total | 22.326 kg |

The coefficient water/cement (E/C) is conventional data, which is employed in the field of concrete.

Insulating part (15 cm thickness)

| | |
|---|---|
| Cellular glass beads resistant to alkali (3–12 mm) | 3.440 kg |
| Special cement | 1.000 kg |
| *Synthetic resins | 4.440 kg |
| | 0.360 kg |
| $\frac{E}{C}$ tot. 0.57 | 0.390 |
| Total | 5.190 kg |

*The synthetic resins are acrylic resins, for example of the type "UCECRYL" (of the Company UCB), "D 510" and "B 500" (of ROEHM and HAAS) etc.

(b) Insulating mortar jointings

| | |
|---|---|
| "GALEX" 0–4 mm | 18.360 kg |
| "GALEX" 0–2 mm (precrushed) | 6.600 kg |
| Ordinary Portland cement | 3.600 kg |
| $\frac{E}{C}$ 0.80 | 2.160 kg |
| Total | 30.720 kg |

In the following table, the weight analysis according to EMPA standards for heat transmission is presented in the case of the above described wall, and for a difference of temperature between the external cold face (−10° C.) and the internal warm face (+20° C.) of 30°:

Table for the calculation of k:

| | |
|---|---|
| k of the finished wall of 38.5 cm | $\frac{0.36}{0.35}$ = 1.028 W/H |
| $\lambda$ of the insulating mortar as expanded slag balls | |

-continued

| | |
|---|---|
| External transmission (according EMPA standards) | $\frac{1}{23}$ = 0.043 W/K |
| External normal rough-cast 2 cm | $\frac{0.02}{0.87}$ 0.023 W/K |
| Internal normal rough-cast 1.5 cm | $\frac{0.015}{0.70}$ = 0.021 W/K |
| Internal transmission (according to EMPA standards) | $\frac{1}{8}$ = 0.125 W/K |
| Total of the horizontal and vertical jointings | R = 1.240 W/K |
| k value of the horizontal and vertical jointings | $\frac{1}{1.240}$ = 0.806 W/m2K |
| That is: 92.5% of the k value of the finished wall of 38.5 cm (0.36) | k = 0.333 W/m2K |
| + 7.5% of the k value of the jointings (0.806) | K = 0.060 W/m2k |
| 100% finished wall of 38.5 cm including the jointings | |
| k total value | = 0.393 W/m2K |

The obtained value for k tot. of 0.393 W/m2K could still be increased by using insulating coatings on the normal rough-casts or instead thereof.

Figure 7:
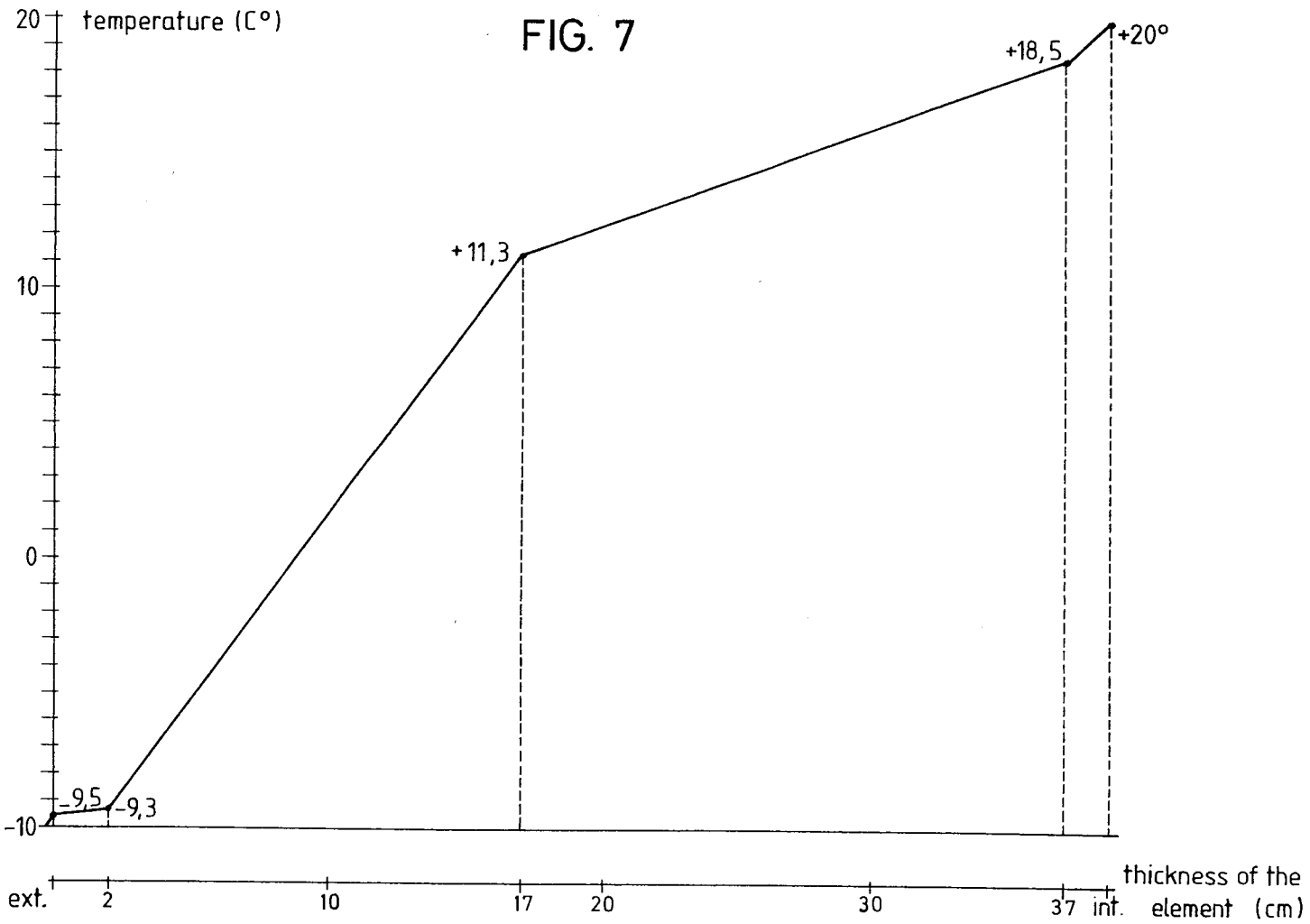
FIG. 7 is a graph representing the heat transmission (temperature vs. element thickness) through a wall realized with elements according to the invention.

Finally, the graph of FIG. 7 shows for the wall described by way of example the temperature curve through the thickness of the wall, from outside towards the inside. In this graph, the internal transmission $\frac{1}{8}$=1.3° K. according to EMPA standard is not mentionned.

Furthermore, thanks to the very low heat transmission coefficient k possessed by the construction elements according to the invention, a wall realized with said elements will show a phase shifting greater than about 14 hours. The phase shifting means here the period between the time from the penetration from the outside of the cold (or of the heat) to the observation of this modification of temperature inside the room; this period of time should be if possible greater than 10–12 hours, so the effects of this difference of phase (or of temperature) are not transmitted to the other side of the wall (to the inside) before these effects have decreased significantly or have disappeared at the outside.

Finally, the shapes and sizes of the blind cavities provided in the bearing part of the element are not limited; however, it has been shown that the configuration illustrated for example in FIG. 2 is that which offers the better resistance to heat transmission.

I claim:

1. Construction element having dimensions of height, width and thickness, comprising a first bearing part formed from a light concrete having compression resistance between 25 and 175 kg/cm$^2$ and an apparent density between 900 and 1250 kg/m$^3$, said bearing part comprising elongated cylindrical cavities extending in said height dimension, elongated in said width dimension, and arranged in alternating rows in said thickness dimension, said cavities forming about 25% by volume of said bearing part; and a second insulating part formed from a hydraulic binder based on cement, a first synthetic resin and an expanded mineral filler, said insulating part having an apparent density of at most 270 kg/m$^3$, said bearing part having a greater extent in said thickness dimension than said insulating part, said bearing and insulating parts being fixed together along a plane substantially perpendicular to said thickness dimension.

2. Construction element according to claim 1, wherein said first bearing part further comprises a second synthetic resin mixed with said light concrete.

3. Construction element according to claim 2, wherein said first and second synthetic resins are acrylic resins.

4. Construction element according to claim 1, wherein said light concrete comprises an hydraulic binder selected from the group consisting of blast furnace slag, pumice stone, crushed terracotta, expanded clay, slate and pozzolana.

5. Construction element according to claim 1, wherein said expanded mineral filler is selected from the group consisting of cellular glass balls, vermiculite, granulated polyurethane, mica, expanded polystyrene and wood chips.

6. Construction element according to claim 1, wherein each said bearing and insulating parts comprise peripheral portions having at least one coupling groove.

7. Construction element according to claim 1, wherein said insulating part has an extent in said thickness dimension equal to at least 40% of the extent of said bearing part in said thickness dimension.

8. Construction element according to claim 1, wherein said element has a rectangular shape when viewed from above.

9. Construction element according to claim 1, wherein bearing part is rectangular and said insulating part has an L-shape and borders two adjacent faces of said bearing part.

* * * * *